US007320953B2

(12) United States Patent
Grissett et al.

(10) Patent No.: US 7,320,953 B2
(45) **Date of Patent: *Jan. 22, 2008**

(54) FIBROUS TOILETTE ARTICLE

(75) Inventors: Gregory Aaron Grissett, Jacksonville, NC (US); Diane Marie Keenan, Derby, CT (US); Filomena Augusta Macedo, Naugatuck, CT (US); David Robert Williams, Monroe, CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 337 days.

This patent is subject to a terminal disclaimer.

(21) Appl. No.: 10/938,384

(22) Filed: Sep. 9, 2004

(65) Prior Publication Data

US 2005/0277566 A1 Dec. 15, 2005

(51) Int. Cl.
*C11D 17/04* (2006.01)
*C11D 11/00* (2006.01)

(52) U.S. Cl. ..... 510/140; 510/141; 510/142; 510/439

(58) Field of Classification Search ..... 510/140, 510/141, 142, 439
See application file for complete search history.

(56) References Cited

U.S. PATENT DOCUMENTS

| | | | | |
|---|---|---|---|---|
| 3,114,928 | A | 12/1963 | Spiteri | |
| 3,293,684 | A | 12/1966 | Tundermann | |
| 3,773,672 | A | 11/1973 | Bredice | |
| 3,931,035 | A | 1/1976 | Brown | |
| 3,949,137 | A | 4/1976 | Akrongold et al. | |
| 4,190,550 | A | 2/1980 | Campbell | |
| 4,240,760 | A | 12/1980 | Levine | |
| 4,457,643 | A | 7/1984 | Caniglia | |
| 4,613,446 | A | 9/1986 | Magyar | |
| 4,741,852 | A | 5/1988 | Ondracek | |
| 4,969,225 | A | 11/1990 | Schubert | |
| 5,221,506 | A | 6/1993 | Dulin | |
| 6,171,007 | B1 | 1/2001 | Hsu | |
| 6,190,079 | B1 | 2/2001 | Ruff | |
| 6,491,937 | B1 * | 12/2002 | Slavtcheff et al. | 424/402 |
| 6,730,642 | B1 | 5/2004 | Aronson et al. | |
| 6,893,182 | B1 | 5/2005 | Liao | |
| 6,896,435 | B1 | 5/2005 | Rink | |
| 2003/0100236 | A1 | 5/2003 | Seth et al. | |
| 2003/0220212 | A1 | 11/2003 | DeVitis | |
| 2004/0110653 | A1 | 6/2004 | Brown | |
| 2005/0113270 | A1 | 5/2005 | Stockman et al. | |

FOREIGN PATENT DOCUMENTS

| | | | |
|---|---|---|---|
| EP | 1 266 599 A1 | | 6/2002 |
| FR | 2 271 808 | | 12/1974 |
| GB | 1473147 | * | 9/1974 |
| WO | 01/08658 | | 2/2001 |
| WO | 2005/007789 A3 | | 1/2005 |

* cited by examiner

*Primary Examiner*—Necholus Ogden, Jr.
(74) *Attorney, Agent, or Firm*—Milton L. Honig

(57) ABSTRACT

A cleansing article is provided which includes a fibrous web of continuous network bonded fibers and a solid or semi-solid foamable composition joinably penetrating the web. The web has a first and second major surface each being on opposite faces of the web. The composition and web are present in a relative weight ratio ranging from about 30:1 to about 2000:1. At least a major portion of the first major surface of the web preferably being exposed above the foamable composition, and a majority of surfaces defining an exterior of the article are formed of the foamable composition.

10 Claims, 1 Drawing Sheet

FIBROUS TOILETTE ARTICLE

BACKGROUND OF THE INVENTION

1. Field of the Invention

The invention concerns a personal care cleansing article, particularly a toilette bar integrated with a non-woven bonded fibrous web.

2. The Related Art

Toilette bars are amongst the oldest forms of personal cleansing articles. Research continues to provide improved bar technology. Many problems exist requiring further solutions. Bars are slippery when wet. Better grabability is needed. Some bars require a long time to generate sufficiently luxurious lather. Quicker foaming bars are necessary. Other types of bars form mush from placement in a wet dish awaiting further use. Mush is aesthetically displeasing both visually and by handling.

Some of the aforementioned problems have sought to be overcome through the use of water-insoluble structural composites combined with soap. A first variety encompasses surrounding a soap bar with a textile or fibrous sheath. For instance, U.S. Pat. No. 4,190,550 (Campbell) describes a seamless envelope of crimped, resilient, stretchy synthetic organic fibers surrounding a core of solid soap or other suitable surfactant material. The envelope is held in integral form solely by the entanglement of the fibers.

U.S. Pat. No. 4,969,225 (Schubert) discloses a scrub brush. This article is formed from an elastic, resilient, synthetic fibrous bat or open-cell chemical foam (preferably polyurethane) having an internal cavity or tunnel containing a bar of soap.

EP 1 266 599 A1 (Duden et al.) reports a solid cleanser holder. The holder is formed of a textured film having texture variations with at least one aperture, the film surrounding a solid cleanser.

U.S. patent application 2004/0033915 A1 (Aleles et al.) reports a cleansing bar which includes a cleansing composition and a plurality of discrete elements, particularly fibers. These discrete elements appear not to be formed into any extended bonded web.

Another body of technical art focuses upon structuring cores surrounded by soap. Apparently in this grouping, the core serves as a scaffold to support the cleansing composition. For instance, U.S. Pat. No. 5,221,506 (Dulin) discloses bar soaps for personal use having a structural center. Illustrative centers include open-celled sponges and woven or non-woven organic filamentary materials. In a FIG. 2 embodiment, a small portion of the structural core protrudes through the surface for reasons of providing a hanger support (e.g. a hole).

U.S. patent application 2003/0220212 A1 (DeVitis) describes a reinforced bar soap. The reinforcement member is provided to prolong usage of a conventional soap composition and to serve as structural reinforcement eliminating soap breakage problems.

U.S. Pat. No. 6,190,079 B1 (Ruff) discloses a scrubbing soap bar composed of vegetable oil/glycerine imbedded with a length of a thin, fine mesh netting. A portion of the netting extends exteriorly of the soap to form a pocket intended for insertion of a human user's fingers to facilitate grasp of the bar.

Although there have been significant advances through the combination of soap compositions with reinforcement and/or textile webs, more discoveries are necessary to improve rate of lather volume generation, minimization of mush and/or degradation of the web structure itself.

SUMMARY OF THE INVENTION

A cleansing article is provided which includes:

(i) a fibrous web including a continuous network of bonded fibers, the web having a first and second major surface each being on opposite faces of the web; and (ii) a solid or semi-solid foamable composition joinably penetrating the web, the composition and the web being present in a relative weight ratio ranging from about 30:1 to about 2000:1, at least a major portion of the first major surface being exposed above the foamable composition, and a majority of surfaces defining an exterior of the article being formed of the foamable composition.

BRIEF DESCRIPTION OF THE DRAWING

Various features and advantages of the present invention will become more apparent through consideration of the following drawing in which.

DETAILED DESCRIPTION OF THE INVENTION

Figure 1:
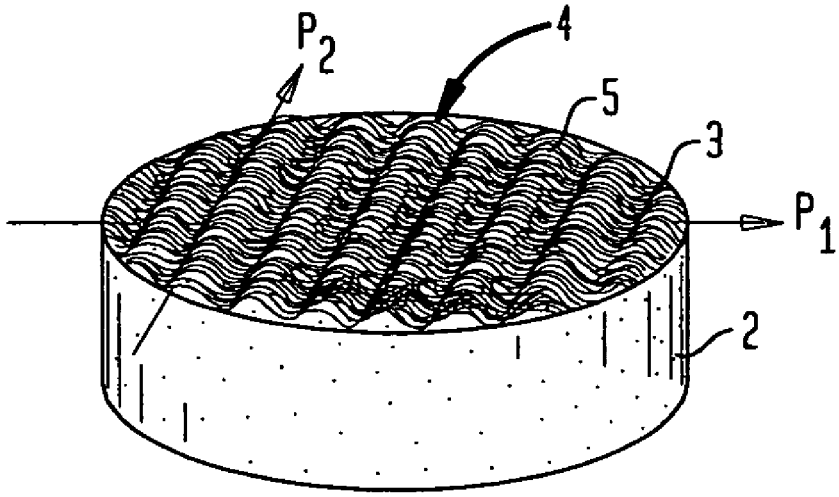
FIG. 1 is a cleansing article according to one embodiment of the present invention.

Now there is provided a personal care cleansing article, particularly a toilette bar wherein one major surface of the bar has an exposed fibrous web.

A variety of fibrous webs can be employed for the present invention. Particularly preferred are fibrous batting webs with a continuous network of bonded fibers. In a preferred embodiment, the batting web may have a Loft-Soft Ratio of greater than about 1.1. In other words, the fibrous web of this invention preferably is lofty and fluid-permeable.

As used herein, "lofty" means that the layer has density of from about 0.01 g/cm$^3$ to about 0.00005 g/cm$^3$ and a thickness of from about 0.1 to about 7 cm.

Loftiness of substrates and softness of substrates are related. Softness has several independent, contributing components. One component is a kind of "pillowy" softness. That is, when a force is applied by hand or finger pressure, the substrate easily compresses in much the same way a pillow compresses under pressure to support a body member resting thereon. The web of the present invention is preferably characterized by having a Loft-Soft Ratio of greater than about 1.1, more preferably greater than about 1.3, and most preferably greater than about 1.5.

The methodology for assessing Loft-Soft Ratio is as follows. Substrate samples are cut using a 1.875 inch diameter punch and hammer. In instances where the punching process inelastically compresses edges of discs, the edges are carefully fluffed to restore original dimension. With the top plate in position, the Instron load cell is calibrated and is then run in compression mode at 0.50 inches/minute rate of descent. The Instron may be controlled manually or by computer as long as the final compression is greater than 30 grams/in$^2$ pressure and data is collected quickly enough (computer assisted recommended) to determine the height at various compression values during descent. The top plate is then moved down until it contacts the base plate at which point the height is set at zero. It is important that the top plate and base plate are parallel, making contact at all points simultaneously.

Once the apparatus is zeroed, the top plate is retracted to a position above the base plate allowing sufficient space to interpose a substrate sample disc. A substrate disc is then placed in the center of the base plate. The Instron is then set to compress each substrate sample once fully. Next, the Instron is turned on and the height and force of the top plate is continuously recorded. Once the compression of the sample is complete, the compression with new samples of the same substrate is repeated as many times as are needed to establish a reliable average. The average height about the base plate at compression values of 5 gms/in$^2$ and 30 gms/in$^2$ equals the thickness at 5 gms/in$^2$ and 30 gms/in$^2$, respectively. The Loft-Soft Ratio is then calculated as the ratio of the thickness at 5 gms/in$^2$ divided by the thickness at 30 gms/in$^2$.

The webs of the present invention are continuous bonded fiber networks known also herein as a fibrous assembly. The assembly is formed of a large number of fiber contact points such that a continuous structure is achieved. The fibers may be synthetic, natural or combinations of these fibers converted via conventional well-known non-woven, woven or knit processing methods. Generally the non-wovens are preferred. Suitable synthetic fibers include but are not limited to polyethylene, polypropylene, polyester, low-melt polyester, viscose rayon, polylactic acid, nylon and any blends/combinations thereof. Additionally, synthetic fibers used herein can be described as staple and continuous filaments. These fibers may be multi-component and have preferably denier ranging from about 1 to about 20 denier. Methods used to arrange and manipulate fibers into a non-woven fibrous assembly include but are not limited to carding/garnetting, airlay, wetlaid, spunbond, meltblown, vertical lapping or combinations thereof. Cohesion, strength and stability are imparted into the fibrous assembly via bonding mechanisms such as that of needle punching, stitch bonding, hydroentangling, chemical bonding and thermal bonding and combinations thereof.

Advantageously, fibrous assemblies of the present invention can range in basis weight from about 25 g/m$^2$ to about 1,000 g/m$^2$. Lather generating can be improved by proper fibrous assembly density and porosity. The term porosity (P) can be defined as the volume fraction of air to fibers within a given fibrous assembly. Porosity can be expressed using the following equation:

$$P = \frac{P_f - P_w}{P_f}$$

wherein $P_f$ is fiber density (g/cm$^3$), $P_w$ is nonwoven density (g/cm$^3$). Note that the nonwoven density is based on the apparent thickness of the nonwoven structure. Preferably, the fibrous assembly of the present invention should display porosity ranging from 0.95 to 0.9999.

Another advantageous material property is resiliency. Specifically, Percent Energy Loss is a useful parameter since it describes the resilience of substrates to an applied loss. The Percent Energy Loss is calculated as follows:

$$\%\ \text{Energy Loss} = \left[\frac{J_T - J_R}{J_T}\right] * 100,$$

wherein $J_T$, is the Total Energy required to compress nonwoven to a 100 gram load and $J_R$ is the Recovered Energy during one compression cycle. Lower energy loss corresponds to a more resilient nonwoven. Preferably, fibrous assemblies of the current invention have percent energy loss values ranging from about 5 to about 50%, preferably from about 5 to about 35%.

The test method for Energy Loss involves use of an Instron Tensile/Compression Testing Machine fitted with a 1.5 inch circular die (sample cutting). The compression cycle strain rate is set at 38 mm/min, the recovery cycle strain rate is also set at 38 mm/min. The maximum load is 100 grams load (approximately 0.98 N), the load cell is 5 N, and the platen separation is 31.75 mm. Total energy is measured which is required to compress a sample to 100 grams. Also measured is the recovered energy from one compression cycle. With these two values, the percent Energy Loss can be calculated based on the above equation.

The solid or semi-solid foamable composition advantageously may have a yield stress value ranging from about 50 kPa to about 400 kPa at 25° C., preferably from about 100 to about 350 and most preferably from about 150 to about 250 kPa.

The solid or semi-solid foaming composition advantageously has a weight relative to the fibrous web that ranges in percent from above 1000% to about 20000%, preferably from 1500% to about 15000%, optimally from about 3000% to about 10000%. Preferably the relative weight ratio of the solid or semi-solid foamable composition to the fibrous web ranges from about 30:1 to about 2000:1, preferably from about 70:1 to about 1200:1, optimally from about 100:1 to about 1000:1.

The most significant functional component of the foamable composition is that of a surfactant. Amounts of the surfactant may range from about 1 to about 50%, preferably from about 5 to about 40% and optimally from about 10 to about 25% by weight of the foamable composition.

One useful surfactant base comprises fatty acid soaps. The term "soap" is used herein in its popular sense, i.e., the alkali metal or alkanol ammonium salts of aliphatic or alkene monocarboxylic acids. Sodium, potassium, magnesium, mono-, di- and tri-ethanol ammonium cations, or combinations thereof, are suitable for purposes of this invention. The soaps most useful herein are the well known alkalimetal salts of natural of synthetic aliphatic (alkanoic or alkenoic) acids having about 8 to 22 carbon atoms, preferably about 8 to about 18 carbon atoms.

A preferred soap is formed from a saponified mixture of about 30% to about 40% coconut oil and about 60% to about 70% tallow. Mixtures may also contain higher amounts of tallow, for example, 15% to 20% coconut and 80 to 85% tallow.

A second type of surfactant base useful in this invention comprises non-soap synthetic type detergents-so called syndet bases. These may be selected from anionic, nonionic, cationic, amphoteric, zwifterionic and surfactant combinations thereof.

The anionic surfactant may be, for example, a primary alkyl sulfonate, primary alkyl disulfonate, alkene sulfonate, hydroxyalkyl sulfonate, alkyl glyceryl ether sulfonate, aromatic sulfonate, alkyl sulfate, alkyl ether sulfate, alkyl glycerol ether sulfates, alkyl sulfosuccinate, alkyl or acyl taurate, alkyl or acyl sarcosinate, sulfoacetate, alkyl phosphate or phosphonate, alkyl phosphate ester or alkoxy alkyl phosphate ester, acyl lactate, monoalkyl succinate or maleate, acyl isethionate and mixtures thereof. Particularly use are the acyl isethionates such as sodium cocoyl isethionate. Counter cations to the anionic surfactants may be sodium, potassium, ammonium or substituted ammonium such as triethanolammonium and mixtures thereof. Whenever the term alkyl, alkene, aromatic or acyl are employed, this is intended to mean a saturated or unsaturated hydrocarbon of straight or branched chain (or benzenoid type) having from about 6 to about 48 carbon atoms, preferably 6 to 22 carbon atoms.

Zwitterionic surfactants useful for the present invention are broadly described as derivatives of aliphatic quaternary ammonium, phosphonium and sulfonium compounds, in which the aliphatic radicals can be straight or branched chain with from 8 to about 22 carbon atoms.

Amphoteric surfactants useful in this invention may be selected from $C_6$-$C_{24}$ betaines, sultaines, hydroxysultaines, alkyliminoacetates, imidoalkanoates, aminoalkanoates, and mixtures thereof. Examples of betaines include coco dimethyl carboxymethyl betaine, coco dimethyl sulfopropyl betaine, oleyl betaine and cocoamidopropyl betaine. Examples of sultaines and hydroxysultaines include materials such as cocoamidopropyl hydroxysultaine. Particularly preferred amphoteric surfactants are cocoamidopropyl betaine, disodium lauroamphodiacetate, sodium lauroamphoacetate and mixtures thereof.

Nonionic surfactants suitable for the present invention are the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl($C_6$-$C_{22}$)phenols-ethylene oxide condensates, the condensation products of aliphatic($C_8$-$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Other nonionics include alkyl glucosides, alkyl polyglucosides, polyhydroxy fatty acid amides, alkoxylated fatty acid esters, sucrose esters, amine oxides and mixtures thereof.

Foamable compositions of the present invention may also include wear promoting agents. These may be selected from such materials as mineral oil, petrolatum, lanolin, lanolin derivatives, C7-C40 branched chain hydrocarbons, C1-C30 alcohol esters of C1-C30 carboxylic acids, C1-C30 alcohol esters of C2-C30 dicarboxylic acids, monoglycerides of C1-C30 carboxylic acids, diglycerides of C1-C30 carboxylic acids, triglycerides of C1-C30 carboxylic acids, ethylene glycol monoesters of C1-C30 carboxylic acids, ethylene glycol diesters of C1-C30 carboxylic acids, propylene glycol monoesters of C1-C30 carboxylic acids, propylene glycol diesters of C1-C30 carboxylic acids, C1-C30 carboxylic acid monoesters and polyesters of sugars, polydialkylsiloxanes, polydiarylsiloxanes, polyalkarylsiloxanes, cyclomethicones having 3 to 9 silicon atoms, vegetable oils, hydrogenated vegetable oils, polypropylene glycol C4-C20 alkyl ethers, di C8-C30 alkyl ethers, and combinations thereof.

Straight and branched chain hydrocarbons having from about 7 to about 40 carbon atoms are useful herein as the wear promoting agents. Nonlimiting examples of these hydrocarbon materials include dodecane, isododecane, squalane, hydrogenated polyisobutylene, docosane, hexadecane, isohexadecane (a commercially available hydrocarbon sold as Permethyl® 101A by Presperse, South Plainfield, N.J.). Also useful are the C7-C40 isoparaffins. Polydecene, a branched liquid hydrocarbon, is also useful herein and is commercially available under the tradename Puresyn 100® from Mobile Chemical (Edison, N.J.).

Nonlimiting examples of ester type wear promoting agents include diisopropyl sebacate, diisopropyl adipate, isopropyl myristate, isopropyl palmitate, myristyl propionate, ethylene glycol distearate, 2-ethylhexyl palmitate, isodecyl neopentanoate, di-2-ethylhexyl maleate, cetyl palmitate, myristyl myristate, stearyl stearate, cetyl stearate, behenyl behenrate, dioctyl maleate, dioctyl sebacate, diisopropyl adipate, cetyl octanoate, diisopropyl dilinoleate, caprylic/capric triglyceride, PEG-6 caprylic/capric triglyceride, PEG-8 caprylic/capric triglyceride, and combinations thereof.

Also useful ester type wear promoting agents are various C1-C30 monoesters and polyesters of sugars and related materials. These esters are derived from a sugar or polyol moiety and one or more carboxylic acid moieties. Depending on the constituent acid and sugar, these esters can be in either liquid or solid form at room temperature. Examples of liquid esters include: glucose tetraoleate, the glucose tetraesters of soybean oil fatty acids (unsaturated), the mannose tetraesters of mixed soybean oil fatty acids, the galactose tetraesters of oleic acid, the arabinose tetraesters of linoleic acid, xylose tetralinoleate, galactose pentaoleate, sorbitol tetraoleate, the sorbitol hexaesters of unsaturated soybean oil fatty acids xylitol pentaoleate sucrose tetraoleate, sucrose pentaoleate, sucrose hexaoleate, sucrose heptaoleate, sucrose octaoleate, and mixtures thereof.

Nonvolatile silicones such as polydialkylsiloxanes, polydarylsiloxanes, and polyalkarylsiloxanes are also useful wear promoting agent. The polyalkylsiloxanes correspond to the general chemical formula $R_3SiO[R_2SiO]_xSiR_3$ wherein R is an alkyl group (preferably R is methyl or ethyl) and x is an integer up to about 500, chosen to achieve the desired molecular weight. Commercially available polyalkylsiloxanes include the polydimethylsiloxanes, which are also known as dimethicones, nonlimiting examples of which include the Vicasil® series sold by General Electric Company and the Dow Coming® 200 series sold by Dow Corning Corporation. Also useful are materials such as trimethylsiloxysilicate, which is a polymeric material corresponding to the general chemical formula $[(CH_2)_3SiO_{1/2}]_x[SiO_2]y$, wherein x is an integer from about 1 to about 500 and y is an integer from about 1 to about 500. A commercially available trimethylsiloxysilicate is sold as a mixture with dimethcione as Dow Corning® 593 fluid. Also useful herein are dimethiconols, which are hydroxy terminated dimethyl silicones. These materials can be represented by the general chemical formulas $R_3SiO[R_2SiO]_xSiR_2OH$ and $HOR_2SiO[R_2SiO]_xSiR_2OH$ wherein R is an alkyl group (preferably R is methyl or ethyl) and x is an integer up to about 500, chosen to achieve the desired molecular weight. Commercially available dimethiconols are typically sold as mixtures with dimethicone or cyclomethicone (e.g. Dow Corning® 1401, 1402, and 1403 fluids). Also useful herein are polyalkylaryl siloxanes, such as polymethylphenyl siloxanes as SF 1075 methylphenyl fluid (sold by General Electric Company) and 556 Cosmetic Grade phenyl trimethicone fluid (sold by Dow Coming Corporation). Alkoxylated silicones such as methyldecyl silicone and methyloctyl silicone are useful herein and are commercially available from the General Electric Company. Also useful herein are alkyl modified siloxanes such as alkyl methicones and alkyl dimethicones wherein the alkyl chain contains 10 to 50 carbons. Such siloxanes are commercially available under the tradenames ABIL WAX 9810 ($C_{24}$-$C_{28}$ alkyl methicone)

(sold by Goldschmidt) and SF1632 (cetearyl methicone) (sold by General Electric Company).

Vegetable oils and hydrogenated vegetable oils are also useful herein as wear promoting agents. Examples of vegetable oils and hydrogenated vegetable oils include safflower oil, castor oil, coconut oil, cottonseed oil, menhaden oil, palm kernel oil, palm oil, peanut oil, soybean oil, rapeseed oil, linseed oil, rice bran oil, pine oil, sesame oil, sunflower seed oil, borage oil, maleated soybean oil, polycottonseedate, polybehenate and mixtures thereof.

The articles of the present invention may optionally include one or more conditioning agents. Nonlimiting examples of conditioning agents include those selected from the group consisting of polyhydric alcohols, polypropylene glycols, polyethylene glycols, ureas, pyrrolidone carboxylic acids, ethoxylated and/or propoxylated C3-C6 diols and triols, alpha-hydroxy C2-C6 carboxylic acids, ethoxylated and/or propoxylated sugars, polyacrylic acid copolymers, sugars having up to about 12 carbon atoms, sugar alcohols having up to about 12 carbon atoms, and mixtures thereof. Specific examples of useful conditioning agents include materials such as urea; guanidine; glycolic acid and glycolate salts (e.g., ammonium and quaternary alkyl ammonium); lactic acid and lactate salts (e.g. ammonium and quaternary alkyl ammonium); sucrose, fructose, glucose, erythritol, sorbitol, mannitol, glycerol, hexanetriol, propylene glycol, butylene glycol, hexylene glycol, and the like; polyethylene glycols such as PEG-2, PEG-3, PEG-30, PEG-50, PEG-100, PEG-14M;

polypropylene glycols such as PPG-9, PPG-12, PPG-15, PPG-17, PPG-20, PPG-26, PPG-30, PPG-34; alkoxylated glucose; hyaluronic acid; cationic skin conditioning polymers (such as Polyquaternium polymers); and mixtures thereof. Glycerol known also as glycerin, in particular, is a preferred conditioning agent in the articles of the present invention.

Cationic polymers may be selected from the group consisting of natural backbone quaternary ammonium polymers selected from the group consisting of Polyquaternium-4, Polyquaternium-10, Polyquaternium-24, PG-hydroxyethylcellulose alkyldimonium chlorides, guar hydroxypropyltrimonium chloride, hydroxypropylguar hydroxypropyltrimonium chloride, and combinations thereof; synthetic backbone quaternary ammonium polymers selected from the group consisting of Polyquaternium-2, Polyquaternium-6, Polyquaternium-7, Polyquaternium-11, Polyquaternium-16, Polyquaternium-17, Polyquaternium-18, Polyquaternium-28, Polyquaternium-32, Polyquaternium-37, Polyquaternium-43, Polyquaternium-44, Polyquaternium-46, polymethacylamidopropyl trimonium chloride, acrylamidopropyl trimonium chloride/acrylamide copolymer, and combinations thereof; natural backbone amphoteric type polymers selected from the group consisting of chitosan, quaternized proteins, hydrolyzed proteins, and combinations thereof; synthetic backbone amphoteric type polymers selected from the group consisting of Polyquaternium-22, Polyquaternium-39, Polyquaternium-47, adipic acid/dimethylaminohydroxypropyl diethylenetriamine copolymer, polyvinylpyrrolidone/dimethylaminoethyl methacrylate copolymer, vinylcaprolactam/polyvinylpyrrolidone/dimethylaminoethylmethacrylate copolymer, vinylcaprolactam/polyvinylpyrrolidone/dimethylaminopropylmethacrylamide terpolymer, polyvinylpyrrolidone/dimethylaminopropylmethacrylamide copolymer, polyamine; and combinations thereof.

When the cationic polymer is a polyamine, it is preferred that the cationic polyamine polymer be selected from the group consisting of polyethyleneimines, polyvinylamines, polypropyleneimines, polylysines and combinations thereof. Even more preferably, the cationic polyamine polymer is a polyethyleneimine.

Therapeutic benefit agents may be incorporated into the compositions.

Illustrative but not limiting are anti-acne actives, anti-wrinkle actives, anti-microbial actives, anti-fungal actives, anti-inflammatory actives, topical anaesthetic actives, artificial tanning agents and accelerators, anti-viral agents, enzymes, sunscreen actives, anti-oxidants, skin exfoliating agents, and combinations thereof.

Vitamins may be included in the compositions. Illustrative are Vitamin A and derivatives (e.g. beta carotene, retinol, retinoic acid, retinyl palmitate, retinyl linoleate, retinyl acetate), Vitamin B (e.g. niacin, niacinamide, riboflavin, pantothenic acid and derivatives), Vitamin C (e.g. ascorbic acid, ascorbyl tetraisopalmitate, magnesium ascorbyl phosphate), Vitamin D, Vitamin E and derivatives thereof (tocopherol, tocopherol palmitate, tocopherol acetate), and mixtures thereof.

Sunscreens may be incorporated into the compositions. Particularly useful are the benzophenone sunscreens such as benzophenone-4, octyl methoxycinnamate (Parsol MCX) and Avobenzene (Parsol 1789). Amounts of the sunscreen may range from about 0.0001 to about 8% by weight of the foamable composition.

Chelates may also be incorporated into the compositions. Particularly preferred are such chelates as sodium EDTA, phosphates and phosphonates such as Dequest 2010® (EHDP) and mixtures thereof.

Particularly in compositions containing significant amounts of soap and based on extrusion processing, the compositions may contain fatty acids which have carbon content from about 8 to about 22. Illustrative fatty acids are stearic acid, palmitic acid, oleic acid, lauric acid, myristic acid, hydroxystearic acid and mixtures thereof. Amounts of the fatty acid may range from about 0.1 to about 40% by weight of the foamable compositions. Fatty acids can serve to plasticize the solid and semi-solid foamable compositions and serve as moisturizing agents.

Foamable compositions of the present invention can contain water. Amounts of water may vary from 1% to 80%, preferably from about 20% to about 75%, optimally from about 50% to about 70% by weight of the composition.

In one embodiment of this invention the compositions may be in the form of hydrocolloidal gels. Gelling agents are required for the hydro gel bars embodiment of the present invention. Amounts of the gelling agent may range from about 0.01 to about 20%, preferably from about 1 to about 15%, optimally from about 3 to about 12% by weight of the composition. Gelling agents include gelatin, carrageenan, xanthan, agar, sclerotium, carboxymethyl cellulose, hydroxyethyl cellulose, hydroxypropyl cellulose, hydroxy ethyl cellulose, hydroxypropyl cellulose, methyl and ethyl cellulose, guar gum, bean gum, natural starches, chemically modified starches (e.g. hydroxypropyl starch) and combinations thereof. Most preferred as gelling agent is gelatin and carrageenan, particularly kappa carrageenan. Gelling agents are those materials which can absorb at least about 40 g water (deionized) per gram of gelling agent, preferably at least about 60 g/g, more preferably at least about 80 g/g.

Compositions of the present invention will generally also contain anti-microbial agents. Illustrative but not limiting examples include methyl paraben, ethyl paraben, propyl paraben, sodium sorbate, sodium benzoate, dimethylol dimethyl hydantoin (DMDM hydantoin), iodopropynylbutylcarbamate, methylchloroisothiazolinone, methylisothiazolinone, trichlosan, trichlorban and mixtures thereof. Amounts of the anti-microbials may range from about 0.0001 to about 2% by weight of the foamable composition.

A wide variety of regulatory approved colorants may be employed. Merely for illustrative purposes these include Red 4, Yellow 5, Blue 1, Titanium Dioxide and mixtures thereof.

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

Except in the operating and comparative examples, or where otherwise explicitly indicated, all numbers in this description indicating amounts of material ought to be understood as modified by the word "about".

The following examples will more fully illustrate the embodiments of this invention. All parts, percentages and proportions referred to herein and in the appended claims are by weight unless otherwise illustrated.

Figure 2:
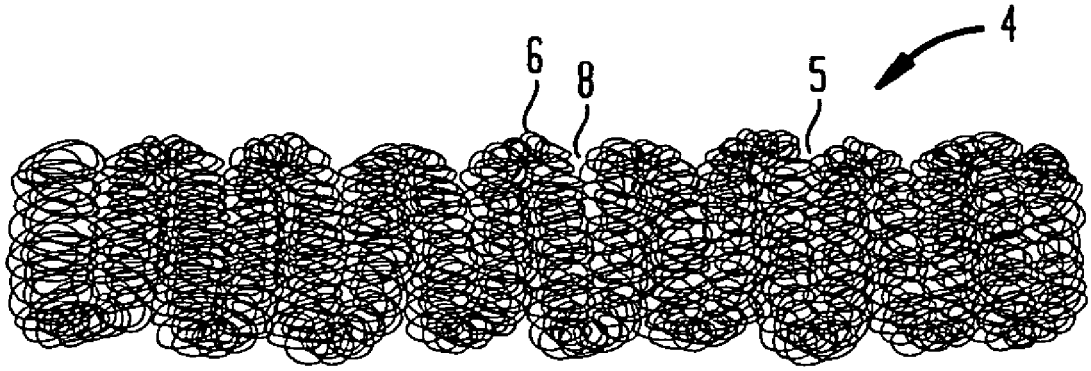
FIG. 2 is a cross-sectional view of a fibrous web (without cleansing composition) illustrating one embodiment of a web useful for the present invention.

FIG. 1 illustrates a personal care cleansing article of the present invention. The article is formed from a foamable composition 2. All but an upper surface 3 of the illustrated bar is formed of the solid or semi-solid foamable composition. Most of upper surface 3 is covered with an anchored layer of fibrous assembly 4 formed from a web of water-insoluble nonwoven polyproplyene or rayon/polypropylene hydroentangled web. The web is structured as shown in FIG. 2 as a series of accordion vertically lapped folds 5. These folds exhibit elongated peaks 6 and valleys 8. Total number of folds may range from about 3 to about 20, preferably from 4 to 15, optimally from 6 to 9 per article.

Folds 5 along a length thereof are characterized by a longitudinal axis $P_2$. The cleansing article as shown in the embodiment of FIG. 1 is an elongate structure defined by a longitudinal axis $P_1$. Advantageously the web 4 is positioned to orient the longitudinal fold axis $P_2$ transverse to the longitudinal article axis $P_1$. Although orientation of $P_2$ parallel to $P_1$ may also be useful, this configuration tends to shrink on manufacture and is easily disrupted through the lathering process. The preferred orientation of $P_2$ to $P_1$ is the transverse orientation with ridges of the corrugated top web face being stable in manufacture and during lathering. Corrugation also assists in achieving faster and higher foam volume than a non-corrugated web system.

EXAMPLE 1

Herein is exemplified a toilette bar with a high oil content. The foamable composition of this bar is reported in Table I.

TABLE I

| INGREDIENT | WEIGHT % |
|---|---|
| Stearic Acid | 13.09 |
| Propylene Glycol | 4.0 |
| Glycerin | 4.0 |
| Sodium Hydroxide | 1.3 |
| Sodium Laureth Sulfate (2 EO) | 4.0 |
| Hydrogenated Cotton Seed Oil | 4.0 |
| Petrolatum | 1.0 |
| 12-Hydroxy Stearic Acid | 9.0 |
| Alpha Olefin Sulfonate | 3.0 |
| Cocoamidopropyl Betaine | 6.0 |

TABLE I-continued

| INGREDIENT | WEIGHT % |
|---|---|
| Titanium Dioxide | 0.75 |
| Sodium Cocoyl Isethionate | 17.89 |
| Sodium Cocoate | 14.88 |
| Zinc Oxide | 0.05 |
| Sunflower Seed Oil | 16.0 |
| Fragrance | 1.0 |
| Diphosphoric Acid | 0.02 |
| Tetrasodium EDTA | 0.02 |

The foamable composition in molten form was poured into a mold cavity. This cavity contained a nonwoven structure similar to that shown in FIG. 2, supplied by Structured Fibers Inc. Total amount of nonwoven was 1.0 g and the foamable composition was 100.0 g. This represents 9100% foamable composition by weight relative to the fibrous assembly.

EXAMPLE 2

Herein is illustrated a toilette bar composition similar to Example 1 but with somewhat higher level of nonwoven. The nonwoven and process for preparing the article were similar to that of the previous example. A 1.0 g nonwoven fibrous assembly was combined with 114.0 g foamable composition. The amount of foamable composition relative to the fibrous assembly calculates to 11400% by weight. The formula of the foamable composition is reported in Table II.

TABLE II

| INGREDIENT | WEIGHT % |
|---|---|
| Stearic Acid | 11.36 |
| Propylene Glycol | 2.47 |
| Glycerin | 4.00 |
| Sodium Hydroxide | 3.94 |
| Sodium Laureth Sulfate 2EO (70%) | 4.57 |
| Hydrogenated Cotton Seed Oil | 3.95 |
| Petrolatum | 1.00 |
| 12-Hydroxy Stearic Acid | 8.00 |
| Sodium C14–16 Olefin Sulfonate | 3.89 |
| Cocoamidopropyl Betaine | 6.00 |
| Sodium Tallowate | 6.34 |
| Sodium Isethionate | 11.98 |
| Sodium Cocoate | 11.35 |
| Zinc Oxide | 0.03 |
| Sunflower Seed Oil | 6.00 |
| Disodium Cocoamphodipropionate | 5.78 |
| Sodium Chloride | 0.03 |
| Deionized Water | 2.27 |
| Sodium Lauryl Sulfate | 6.00 |
| Fragrance | 1.00 |
| Diphosphoric Acid | 0.02 |
| Tetrasodium EDTA | 0.02 |
| Total | 100 |

EXAMPLE 3

Herein is illustrated a hydrogel pliable (rubbery) toilette bar. The formula of the foamable composition is found in Table III.

TABLE III

| INGREDIENT | WEIGHT % |
|---|---|
| Deionized Water | 41.89 |
| Polyquaternium-10 | 0.1 |
| Sodium Chloride | 0.325 |
| Sodium Hydroxide 50% | 0.048 |
| Glycerin USP | 1.00 |
| Ammonium Lauryl Sulfate | 5.08 |
| Ammonium Laureth Sulfate 2EO (70%) | 3.97 |
| Cocamide MEA | 0.869 |
| PEG-5 Cocamide MEA | 0.4345 |
| Citric Acid | 0.078 |
| DMDM Hydantoin | 0.017 |
| Cocamidopropyl Betaine | 10.00 |
| Propylene Glycol USP | 0.283 |
| Deionized Water | 25.00 |
| Gelatin | 10.00 |
| Tetrasodium EDTA 39% | 0.05 |
| Dequest 2010 (EHDP) | 0.033 |
| Kathon CG | 0.02 |
| Fragrance | 0.8 |
| Color | 0.0025 |
| Total | 100 |

In a process similar to that described for Example 1, the nonwoven fibrous assembly (1.25 g) was combined with 114.0 g of the foamable composition. This represents 7831% foamable composition by weight of fibrous assembly.

EXAMPLE 4

The foamable composition yield stress is a measure of relative softness of a toilette bar. For purposes of the current invention, yield stress was calculated for Examples 1-3. Results are found in Table IV.

TABLE IV

| Example No. | Yield Stress |
|---|---|
| 2 | 209.5 |
| 3 | 145.7 |

The Cheese Cutter Method was utilized to evaluate Yield Stress. A toilette bar dimensioned 1.25 inches by 1.25 inches by 2 inches was placed in a "V" shaped retainer. A metal wire held taut by a hinged arm was released against the square-cut toilette bar with a 400 g weight against the arm. The wire cutter was allowed to lean against the toilette bar for 1 minute. The bar was then pushed through the wire horizontally to cut a wedge out of the sample. Length of the sample cut and temperature were recorded. Yield stress ($\sigma_o$) in kPa units is measured as follows:

$$\sigma_o = 0.375\ mg \div 1D$$

wherein, m=mass of driving wire (mass placed on device plus 56 grams)

g=gravitational constant (9.8 m/s$^2$)

1=length of wire penetrating soap bar after 1 minute (mm)

D=diameter of wire (mm)

EXAMPLE 5

Lather improvement was measured for the toilette bars of Example 1-3 and also for the same foamable composition toilette bars without nonwoven fibrous network. Results are recorded in Table V.

TABLE V

| Example 1 | Without Nonwoven (ml) | With Nonwoven (ml) | LIF |
|---|---|---|---|
| 1 | 90 | 188.33 | 2.09 |
| 2 | 115 | 201.67 | 1.75 |
| 3 | 160 | 236.67 | 1.47 |

Based on the results in Table V, it is evident that the nonwoven increased lather generation by a factor of 1.47 to 2.1. Significant differences were observed at the 95% confidence level (p less than 0.05).

Lather volume improvement as reported above was calculated via the following equation:

$$LIF = \frac{V_W}{V_N}$$

wherein $V_w$ is the volume of lather produced with a nonwoven present and $V_N$ is the volume of lather produced without a nonwoven present.

Protocol of the method involved pouring 200 ml of 38° C. water at a rate of 5.26 mm/sec down a sheet of bubble wrap (23×38 cm) inclined at 45° into a 4,000 ml funnel (25.4 cm diameter). Simultaneously with pouring of the water, the sample toilette bar is caused to oscillate in motion parallel to a longitudinal axis of the bubble wrap. About 60-70 strokes of oscillation should occur before waterfall is terminated. Lather generated by the water passing over the toilette bar is collected from the 4,000 ml funnel and trapped in a closed separatory funnel. Thereafter, the stopcock of the separatory funnel is slowly rotated to release water. Upon release of all the water, the stopcock is closed and lather volume in the calibrated separatory funnel is measured.

EXAMPLE 6

Three different nonwoven fibrous assemblies were evaluated for the relationship of porosity and lather volume improvement. Results are recorded in Table VI.

TABLE VI

| Sample | Porosity of Nonwoven | Lather Volume (ml) With Nonwoven | Lather Volume (ml) Without Nonwoven | LIF | % Energy Loss |
|---|---|---|---|---|---|
| A | 0.983 | 195 | 150 | 1.300 | 39.8 |
| B | 0.985 | 205 | 150 | 1.366 | 13.1 |
| C | 0.995 | 225 | 150 | 1.500 | 15.8 |

A 30 ml increase in lather volume was observed when porosity increased from 0.983 to 0.995. The toilette bars of Examples 1-3 all utilized the fibrous assembly having the 0.995 porosity. The results of Table VI also show that the high porosity samples reflect low percent energy loss values. The latter indicates improved resilience of the fibrous network leading to improved dimensional stability of the structures over time.

What is claimed is:

1. A cleansing article comprising:

(i) a fibrous web comprising a continuous network of bonded fibers, the web having a first and second major surface each being on opposite faces of the web and having a porosity ranging from 0.985 to 0.999; and (ii) a solid or semi-solid foamable composition joinably penetrating the web, the composition and the web being present in a relative weight ratio ranging from about 30:1 to about 2000:1, at least a major portion of the first major surface being exposed above the foamable composition, and a majority of surfaces defining an exterior of the article being formed of the foamable composition, the article being a toilet bar.

2. The article according to claim 1 wherein the foamable composition has a yield stress ranging from about 50 kPa to about 400 kPa at 25° C.

3. The article according to claim 1 wherein the fibrous web has a corrugated surface.

4. The article according to claim 3 wherein a longitudinal axis of the article and a fold axis of the corrugated structure are oriented transverse to one another.

5. The article according to claim 1 wherein the fibrous web covers from about 1 to about 40% of the exterior surface of the article prior to initial consumer use.

6. The article according to claim 1 wherein the foamable composition comprises from about 0.01 to about 20% of a gelling agent which can absorb at least about 40 g water per gram of the gelling agent.

7. The article according to claim 1 wherein the foamable composition comprises sodium cocoyl isethionate.

8. The article according to claim 1 wherein the fibrous web has a Loft-Soft Ratio greater than about 1.1.

9. A cleansing article comprising:

(i) a fibrous web comprising a continuous network of bonded fibers, the web being folded forming a surface having a porosity ranging from 0.985 to 0.999-0; and (ii) a solid or semi-solid foamable composition joinably penetrating the web, the composition and the web being present in a relative weight ratio ranging from about 30:1 to about 2000:1, the article being a toilet bar.

10. The article according to claim 1 wherein the foamable composition has a yield stress ranging from about 150 to about 250 kPa.

* * * * *